US011648770B2

(12) United States Patent
Kobayashi et al.

(10) Patent No.: US 11,648,770 B2
(45) Date of Patent: May 16, 2023

(54) LIQUID EJECTION DEVICE

(71) Applicant: SEIKO EPSON CORPORATION, Tokyo (JP)

(72) Inventors: Hiroki Kobayashi, Matsumoto (JP); Takahiro Kanegae, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 194 days.

(21) Appl. No.: 17/071,191

(22) Filed: Oct. 15, 2020

(65) Prior Publication Data

US 2021/0114371 A1 Apr. 22, 2021

(30) Foreign Application Priority Data

Oct. 18, 2019 (JP) ..... JP2019-190898

(51) Int. Cl.
*B41J 2/045* (2006.01)
*B41J 2/175* (2006.01)

(52) U.S. Cl.
CPC ..... *B41J 2/04563* (2013.01); *B41J 2/04586* (2013.01); *B41J 2/17563* (2013.01)

(58) Field of Classification Search
CPC ..... B41J 2/17563; B41J 2/04563; B41J 2/14; B41J 2/2017; B41J 2/04586
See application file for complete search history.

(56) References Cited

U.S. PATENT DOCUMENTS

2011/0285768 A1* 11/2011 Preckel ..... B41J 3/4073 347/20

FOREIGN PATENT DOCUMENTS

JP 2013-184336 9/2013

* cited by examiner

*Primary Examiner* — Thinh H Nguyen
(74) *Attorney, Agent, or Firm* — Workman Nydegger

(57) ABSTRACT

A control section controls an ejection operation to eject liquid in each of a first state in which the liquid flows from a supply tank to a liquid ejection head in a supply channel, the liquid flows from the liquid ejection head to a collection tank in a collection channel, and the liquid flows from the collection tank to the supply tank in a feedback channel, and a second state in which the liquid flows from the supply tank to the liquid ejection head in the supply channel and the liquid flows from the supply tank to the liquid ejection head and the liquid flows from the collection tank to the liquid ejection head in the collection channel.

17 Claims, 10 Drawing Sheets

LIQUID EJECTION DEVICE

The present application is based on, and claims priority from JP Application Serial Number 2019-190898, filed on Oct. 18, 2019, the disclosure of which is hereby incorporated by reference herein in its entirety.

BACKGROUND

1. Technical Field

The present disclosure relates to a liquid ejection device.

2. Related Art

As an example of liquid ejection devices, for example, an ink jet printer that performs printing by ejecting ink from an ink jet head to paper is disclosed in JP-A-2013-184336. Such an ink jet printer is configured to supply ink, for example, from a sub tank to an ink jet head and feed back the ink from the ink jet head to a collection tank through an exhaust channel to cause the ink to circulate. Furthermore, there are ink jet printers in which an ejection defect is suppressed by collecting bubbles or the like in a flow channel, adjusting temperature in the channel, or the like. Note that the collection tank is used only for collecting the ink during circulation, and therefore, only a supply tank supplies the ink to the ink jet head.

However, there is a problem that, in a case in which an ejection amount of the ink is large, when the ink is supplied only from the supply tank, an ink supply amount to the head is insufficient.

SUMMARY

According to an aspect of the present disclosure, a liquid ejection device includes a liquid ejection head configured to eject liquid, a first reservoir configured to store liquid that is supplied to the liquid ejection head, a second reservoir configured to store liquid collected from the liquid ejection head, a first flow channel configured to communicate the liquid ejection head and the first reservoir with each other, a second flow channel configured to communicate the liquid ejection head and the second reservoir with each other, a third flow channel configured to communicate the first reservoir and the second reservoir with each other, and an ejection control section configured to control an ejection operation of ejecting the liquid from the liquid ejection head, the ejection control section controls the ejection operation to eject the liquid in each of a first state in which the liquid flows from the first reservoir to the liquid ejection head in the first flow channel, the liquid flows from the liquid ejection head to the second reservoir in the second flow channel, and the liquid flows from the second reservoir to the first reservoir in the third flow channel and a second state in which the liquid flows from the first reservoir to the liquid ejection head in the first flow channel and the liquid flows from the second reservoir to the liquid ejection head in the second flow channel.

In the above described liquid ejection device, in the second state, the liquid may flow from the second reservoir to the first reservoir in the third flow channel.

In the above described liquid ejection device, a flow channel resistance of the second flow channel may be smaller than a flow channel resistance of the first flow channel.

The above described liquid ejection device may further include a temperature detection section configured to detect temperature of the liquid, and a temperature adjustment section configured to adjust the temperature of the liquid, based on a detection result of the temperature detection section.

In the above described liquid ejection device, the temperature detection section may include a first temperature detection section configured to detect the temperature of the liquid in the first flow channel and a second temperature detection section configured to detect the temperature of the liquid in the second flow channel, the temperature adjustment section may include a first temperature adjustment section arranged in the first reservoir and a second temperature adjustment section arranged in the second reservoir, the first temperature adjustment section may be configured to adjust the temperature of the liquid in the first reservoir, based on a detection result of the first temperature detection section, and the second temperature adjustment section may be configured to adjust the temperature of the liquid in the second reservoir, based on a detection result of the second temperature detection section.

In the above described liquid ejection device, the first temperature adjustment section and the second temperature adjustment section may be configured to adjust the temperature of the liquid such that the temperature of the liquid in the second reservoir is higher than the temperature of the liquid in the first reservoir.

In the above described liquid ejection device, a filter configured to catch a foreign matter in the liquid may be provided in the first reservoir and the second reservoir.

In the above described liquid ejection device, the second reservoir may be arranged higher in a gravity direction than the first reservoir.

In the above described liquid ejection device, the first reservoir and the second reservoir may be arranged higher in the gravity direction than the liquid ejection head.

In the above described liquid ejection device, the ejection control section may be configured to control the ejection operation such that, when an ejection amount per unit time is a first amount, the liquid is ejected in the first state and, when the ejection amount per unit time is a second amount that is larger than the first amount, the liquid is ejected in the second state.

In the above described liquid ejection device, the liquid ejection head may be configured to perform the ejection operation while performing scanning relatively on a unit region on a recording medium, the ejection control section may be configured to control the ejection operation such that, when the number of times the scanning is performed on the unit region is a first number of times, the liquid is ejected in the first state and, when the number of times the scanning is performed on the unit region is a second number of times that is less than the first number of times, the liquid is ejected in the second state.

In the above described liquid ejection device, the liquid ejection head may be configured to perform the ejection operation while performing scanning relatively on a unit region on a recording medium, and the ejection control section may be configured to control the ejection operation such that, when speed of the scanning performed on the unit region is first speed, the liquid is ejected in the first state and, when the speed of the scanning performed on the unit region is second speed that is higher than the first speed, the liquid is ejected in the second state.

In the above described liquid ejection device, the liquid ejection head may include a liquid ejection section configured to eject liquid, a fourth flow channel configured to communicate the liquid ejection section and the first flow channel with each other, and a fifth flow channel configured to communicate the liquid ejection section and the second flow channel with each other, and a flow channel resistance of the fifth flow channel may be smaller than a flow channel resistance of the fourth flow channel.

In the above described liquid ejection device, the second flow channel may further include a switching section configured to switch between an allowable state in which a flow of the liquid from the second reservoir to the liquid ejection head is allowed and an unallowable state in which a flow of the liquid from the second reservoir to the liquid ejection head is not allowed, and a switching control section configured to control an operation of the switching section such that a flow of the liquid is put in the second state by putting the switching section in the allowable state and a flow of the liquid is put in the first state by putting the switching section in the unallowable state.

In the above described liquid ejection device, the switching control section may be configured to control, when a signal from a flow amount detection section arranged in the first flow channel is detected and a flow amount that can be possibly in the allowable state is detected, switching to the allowable state regardless of the ejection operation.

DESCRIPTION OF EXEMPLARY EMBODIMENTS

Embodiments of the present disclosure will be described below with reference to the accompanying drawings. Note that, in each of the drawings below, each layer or each member is illustrated in a different scale from an actual scale thereof in order to make each layer or each member large enough such that each layer or each member is recognizable.

First Embodiment

Figure 1:
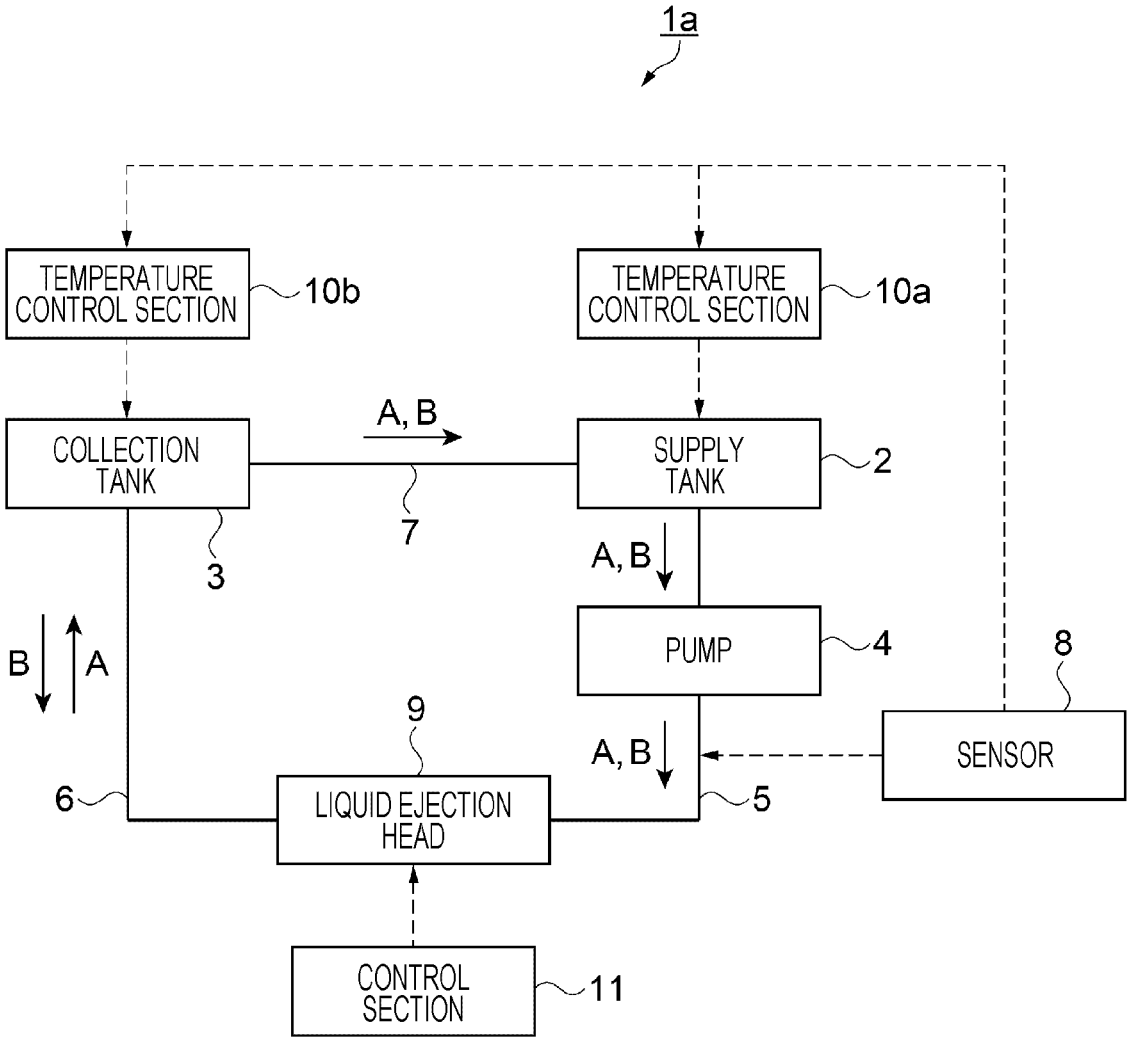
FIG. 1 is a block diagram illustrating a configuration of a liquid ejection device according to a first embodiment.

FIG. 1 is a conceptual block diagram illustrating an entire configuration of a liquid ejection device 1*a*. The entire configuration of the liquid ejection device 1*a* will be described below with reference to FIG. 1.

As illustrated in FIG. 1, the liquid ejection device 1*a* includes a supply tank 2 as a first reservoir, a collection tank 3 as a second reservoir, a pump 4, a supply channel 5 as a first flow channel, a collection channel 6 as a second flow channel, a sensor 8 as a temperature detection section and a first temperature detection section, and a liquid ejection head 9.

Liquid is, for example, ink having a predetermined viscosity. The supply tank 2 includes a temperature control section 10*a* as a first temperature adjustment section. The collection tank 3 includes a temperature control section 10*b* as a second temperature adjustment section. Temperature of the liquid is detected by the sensor 8 provided in the supply channel 5 and is adjusted via the temperature control section 10*a* and the temperature control section 10*b*.

The supply tank 2 is a liquid reservoir member configured to store liquid that is ejected from the liquid ejection head 9. The liquid in the supply tank 2 is supplied to the liquid ejection head 9 via the pump 4 and the supply channel 5.

The collection tank 3 is a liquid reservoir member configured to store ink discharged from the liquid ejection head 9. Specifically, when the liquid supplied from the supply tank 2 to the liquid ejection head 9 is not ejected but is discharged from the liquid ejection head 9, the collection tank 3 stores the liquid via the collection channel 6. The supply tank 2 and the collection tank 3 are connected to each other via a feedback channel 7 as a third flow channel.

The pump 4 is provided in the supply channel 5 between the supply tank 2 and the liquid ejection head 9. Specifically, the pump 4 serving as a liquid sending function that sends the liquid to the liquid ejection head 9 via the supply channel 5 adjusts a pressure of liquid to be supplied to a predetermined pressure. The pump 4 is formed of, for example, a tube pump or a diaphragm pump. Note that the pump 4 may be configured so as not to be arranged in the supply channel 5.

A control section 11 serving as an ejection control section includes a processing circuit, such as, for example, a central processing unit (CPU), a field programmable gate array (FPGA), or the like, and a memory circuit, such as a semiconductor memory or the like, and controls the liquid ejection head 9. Note that a plurality of control sections 11 may be provided and, in that case, the plurality of control sections 11 may be configured such that one of the control sections 11 and the other ones of the control sections 11 execute different processing.

Figure 2:
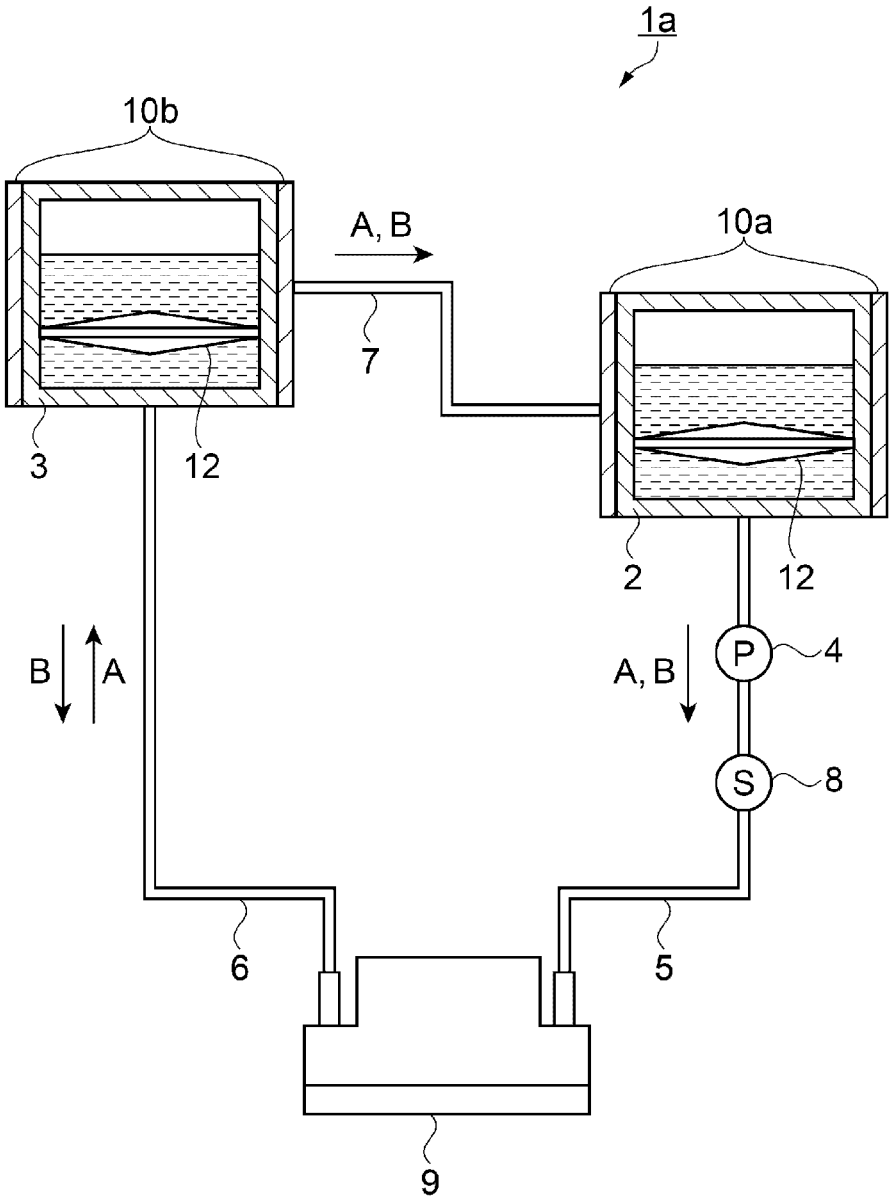
FIG. 2 is a schematic diagram illustrating the configuration of the liquid ejection device according to the first embodiment.
Figure 3:
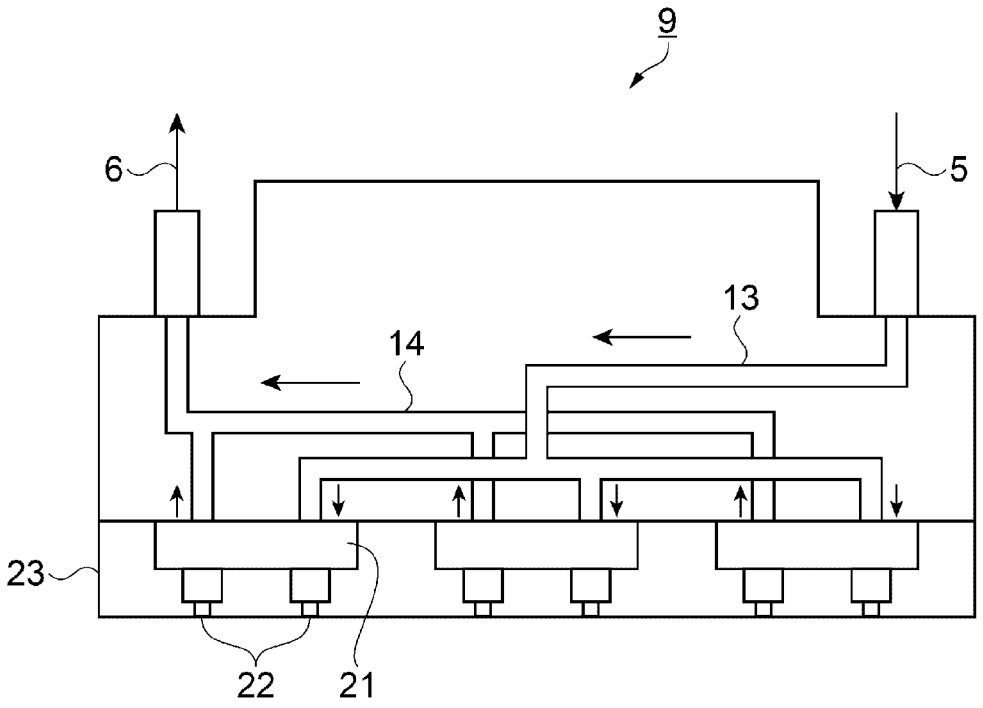
FIG. 3 is a schematic diagram illustrating a configuration of a liquid ejection head.

FIG. 2 is a conceptual diagram illustrating a configuration of the liquid ejection device 1*a* in the first embodiment. FIG. 3 is a conceptual diagram illustrating a configuration of the liquid ejection head 9 that forms the liquid ejection device 1*a*. The configurations of the liquid ejection device 1*a* and the liquid ejection head 9 will be described below with reference to FIG. 2.

As illustrated in FIG. 2, the liquid ejection device 1*a* includes the supply tank 2, the supply channel 5 that connects the supply tank 2 and the liquid ejection head 9, the collection channel 6 that connects the liquid ejection head 9 and the collection tank 3, and the feedback channel 7 that connects the collection tank 3 and the supply tank 2.

Liquid circulates in each flow channel due to the pump 4 functioning as a liquid sending mechanism. Note that, in FIG. 2, a liquid reservoir used for supplementing the liquid by an amount corresponding to liquid consumed by ejection from the liquid ejection head 9 is not illustrated. Although the configuration of the liquid ejection device 1*a* that uses one type of liquid is illustrated in FIG. 2, in a configuration in which a plurality of types of liquid are used, a liquid ejection device is provided for liquid of each type. Moreover, although one liquid ejection head 9 is illustrated in FIG. 2, the number of the liquid ejection heads 9 may be one or more. Note that a configuration in which connection is made from the collection tank 3 to the supply tank 2 is common.

In this embodiment, a first state in which the liquid flows in an A direction in each flow channel and a second state in which the liquid flows in a B direction in each flow channel can be established.

The first state is a state in which the liquid flows from the supply tank 2 toward the liquid ejection head 9 in the supply channel 5, the liquid flows from the liquid ejection head 9 to the collection tank 3 in the collection channel 6, and the liquid flows from the collection tank 3 to the supply tank 2 in the feedback channel 7. That is, in the first state, the liquid circulates between the supply tank 2, the liquid ejection head 9, and the collection tank 3 via the supply channel 5, the collection channel 6, and the feedback channel 7. A flow of the liquid in the first state can be caused by driving of the pump 4 and pressure control of the collection tank 3 and the supply tank 2.

The second state is a state in which the liquid flows from the supply tank 2 toward the liquid ejection head 9 in the supply channel 5, the liquid flows from the collection tank 3 to the liquid ejection head 9 in the collection channel 6, and the liquid flows from the collection tank 3 to the supply tank 2 in the feedback channel 7. That is, in the second state, the liquid flows from both of the supply tank 2 and the collection tank 3 to the liquid ejection head 9. Therefore, in the second state, a supply amount of the liquid to the liquid ejection head 9 per unit time is larger than that in the first state, and a shortage of liquid supply is less likely to occur.

The second state is used in a case in which the supply amount of the liquid to the liquid ejection head 9 is insufficient. For example, in a case in which the liquid is supplied to the liquid ejection head 9 only by driving of the pump 4 in the first state, when an ejection amount of the liquid from the liquid ejection head 9 per unit time is larger than the supply amount of the liquid to the liquid ejection head 9 by driving of the pump 4, the first state is switched to the second state.

In this case, the collection tank 3 is arranged higher in a gravity direction than the supply tank 2, and therefore, also in the second state, the liquid flows from the collection tank 3 to the supply tank 2 in the feedback channel 7 in a manner described above. However, in the second state, the liquid flows from the collection tank 3 to the liquid ejection head 9, and therefore, the supply amount of the liquid from the collection tank 3 to the supply tank 2 in the feedback channel 7 is smaller in the second state than in the first state.

In this case, in the second state, it can be made easier to cause the liquid to flow in the B direction by causing a flow channel resistance of the collection channel 6 to be smaller than a flow channel resistance of the supply channel 5.

As illustrated in FIG. 3, the liquid ejection head 9 includes a liquid ejection section 23, a fourth flow channel 13 that supplies liquid to the liquid ejection section 23, and a fifth flow channel 14 that discharges liquid that has not been ejected by the liquid ejection section 23.

The liquid ejection section 23 includes a plurality of nozzles 22 that discharge liquid and a plurality of common liquid chambers 21 in which liquid supplied from the fourth flow channel 13 is stored.

In the fourth flow channel 13 that supplies the liquid to each of the common liquid chambers 21, as a flow channel cross-sectional area is increased, a flow channel resistance is reduced, and therefore, a flow velocity of the liquid in the fourth flow channel 13 is increased. Thus, there is a high probability that bubbles stay in the fourth flow channel 13. This is because bubbles move from a lower side to an upper side due to buoyancy and, on the other hand, when the flow channel cross-sectional area is increased to increase a velocity of a flow of the liquid from the upper side to the lower side in the fourth flow channel 13, the bubbles are prevented from escaping to the upper side. Therefore, considering a bubble discharging capability, it is not preferable to increase the flow channel cross-sectional area and reduce the flow channel resistance for the purpose of increasing the amount of liquid that is supplied.

On the other hand, in the fifth flow channel 14, the liquid flows from the lower side to the upper side in the first state, and therefore, even when the flow channel cross-sectional area is increased, the bubble discharging capability is not inhibited. Therefore, in this embodiment, the flow channel resistance of the collection channel 6 is smaller than the flow channel resistance of the supply channel 5. According to this configuration, when the supply amount of liquid to the liquid ejection head 9 is insufficient and the first state transitions to the second state, it can be made easier to cause the liquid to flow in the B direction.

As a temperature adjustment function that adjusts temperature of liquid in a circulation flow channel, for example, the sensor 8 configured to detect the temperature of the liquid is provided in the supply channel 5, and the temperature control section 10*a* and the temperature control section 10*b* that adjust the temperature of the liquid in the circulation flow channel, based on a detection result of the sensor 8, are provided in the supply tank 2 and the collection tank 3. According to this configuration, the temperature of the liquid in the circulation flow channel can be kept at a uniform level and circulation can be stably performed.

Note that, separate from the sensor 8 arranged in the supply channel 5, a sensor (not illustrated) serving as a temperature detection section and a second temperature detection section that detect the temperature of the liquid may be arranged in the collection channel 6. In this case, the temperature control section 10*a* can adjust the temperature of the liquid in the supply tank 2, based on the detection result of the sensor 8 arranged in the supply channel 5, and the temperature control section 10*b* can adjust the temperature of the liquid in the collection tank 3, based on a detection result of the sensor arranged in the collection channel 6.

As for temperatures of the supply tank 2 in which the temperature control section 10*a* is provided and the collection tank 3 in which the temperature control section 10*b* is provided, a control temperature of the temperature control section 10*b* is set higher than a control temperature of the temperature control section 10*a*, and thus, a temperature gradient can be formed between the collection tank 3 and the supply tank 2, so that circulation in the feedback channel 7 can be efficiently performed. Specifically, temperature of ink is adjusted such that the temperature of the ink in the collection tank 3 is higher than the temperature of the ink in the supply tank 2.

Furthermore, a water head difference can be generated by setting a level at which the collection tank 3 is arranged higher in the gravity direction than a level at which the supply tank 2 is arranged, so that circulation can be efficiently performed by water pressure head control.

Moreover, the supply tank 2 and the collection tank 3 are arranged higher in the gravity direction than the liquid ejection head 9, and thus, a liquid circulation system can be set near the liquid ejection head 9. As a result, the entire liquid ejection device 1*a* can be arranged in a space-saving manner, the device can be made compact, and deterioration of the temperature adjustment function due to heat radiation in the liquid circulation flow channel can be suppressed.

A filter 12 is provided in the supply tank 2 and the collection tank 3 in order to catch foreign matters and bubbles in the circulation flow channel. Thus, specially, bubbles existing in the circulation flow channel can be reliably caught and, even in a case in which the liquid flows in the B direction from the collection tank 3 in the second state, the bubbles can be prevented from mixing into the liquid ejection head 9. Furthermore, the filter 12 is arranged in the tanks 2 and 3, and thus, an area of the filter 12 that can be possibly a flow channel resistance can be made large, so that there is no longer a concern about a shortage of liquid supply due to increase of the flow channel resistance caused by disposing of the filter 12.

There is a probability that an ejection state of the liquid ejection head 9 that can be possibly the second state occurs in a case in which an ejection operation is controlled by the control section 11 such that an ejection amount per unit time is a second amount that is larger than a first amount. The ejection amount can be calculated based on a setting ejection amount of one nozzle per unit time x the number of ejecting nozzles x the number of times an ejection is performed and, when the ejection amount exceeds a circulation flow amount, the second state is established. For example, in a case in which the liquid ejection head 9 performs an ejection operation while performing scanning relatively on a unit region on a recording medium and the number of times scanning is performed on the unit region is small, the number of times an ejection is performed per scanning is increased, and therefore, the ejection amount per unit time is increased. In a case in which the liquid ejection head 9 performs the ejection operation while performing scanning relatively on the unit region on the recording medium and scanning speed of scanning performed on the unit region is high, the ejection amount per unit time is large. Therefore, in a case in which the number of times scanning is performed is small or in a case in which the scanning speed is high, the second state is established.

As described above, according to the liquid ejection device 1*a* according to the first embodiment, the following advantageous effects can be achieved.

According to the first embodiment, the first state and the second state can be controlled by the control section 11 and, in a case in which the ejection amount from the liquid ejection head 9 is increased to be larger than the circulation flow amount, the control section 11 performs control to establish the second state, and therefore, the ink supply amount can be supplemented from the collection tank 3, so that a shortage of the supply amount of the liquid can be reduced.

Second Embodiment

Figure 4:
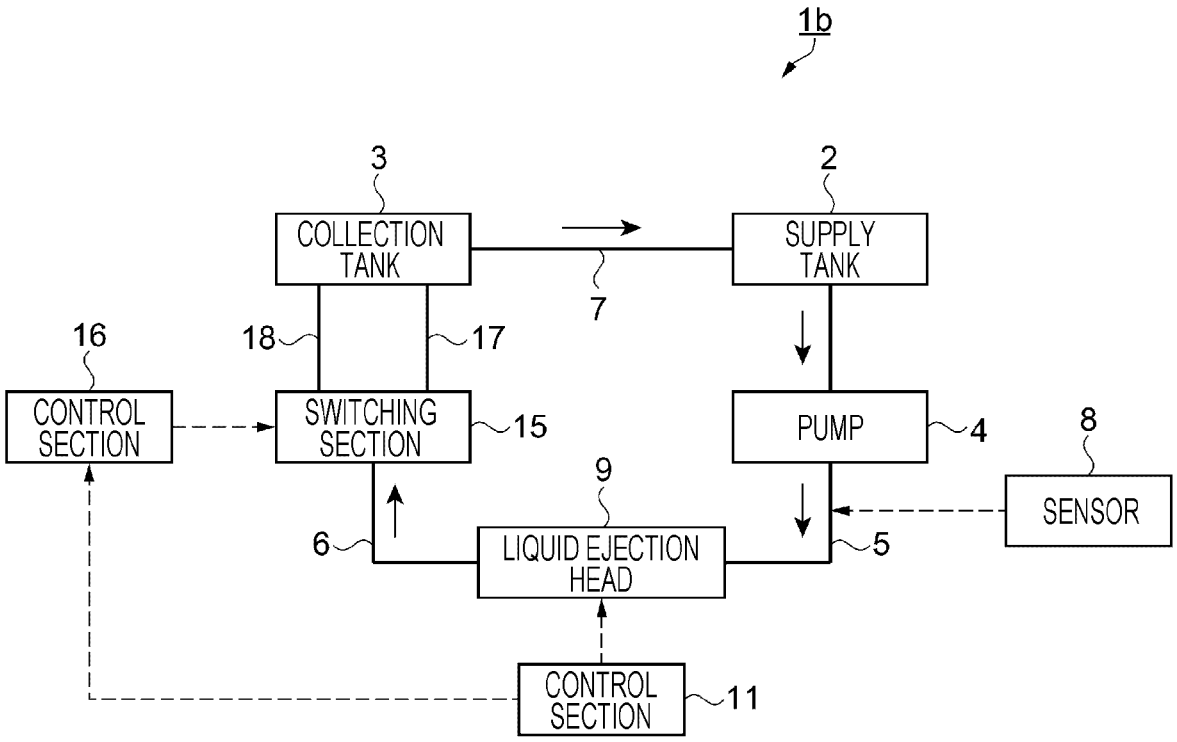
FIG. 4 is a block diagram illustrating a configuration of a liquid ejection device according to a second embodiment.

FIG. 4 is a block diagram of a liquid ejection device 1*b* in a second embodiment. An entire configuration of the liquid ejection device 1*b* in the second embodiment will be described below with reference to FIG. 4. Note that the same components as those in the first embodiment are denoted by the same reference symbols and overlapping description will be omitted. The description of similar parts as those in the first embodiment will be also omitted.

Figure 5:
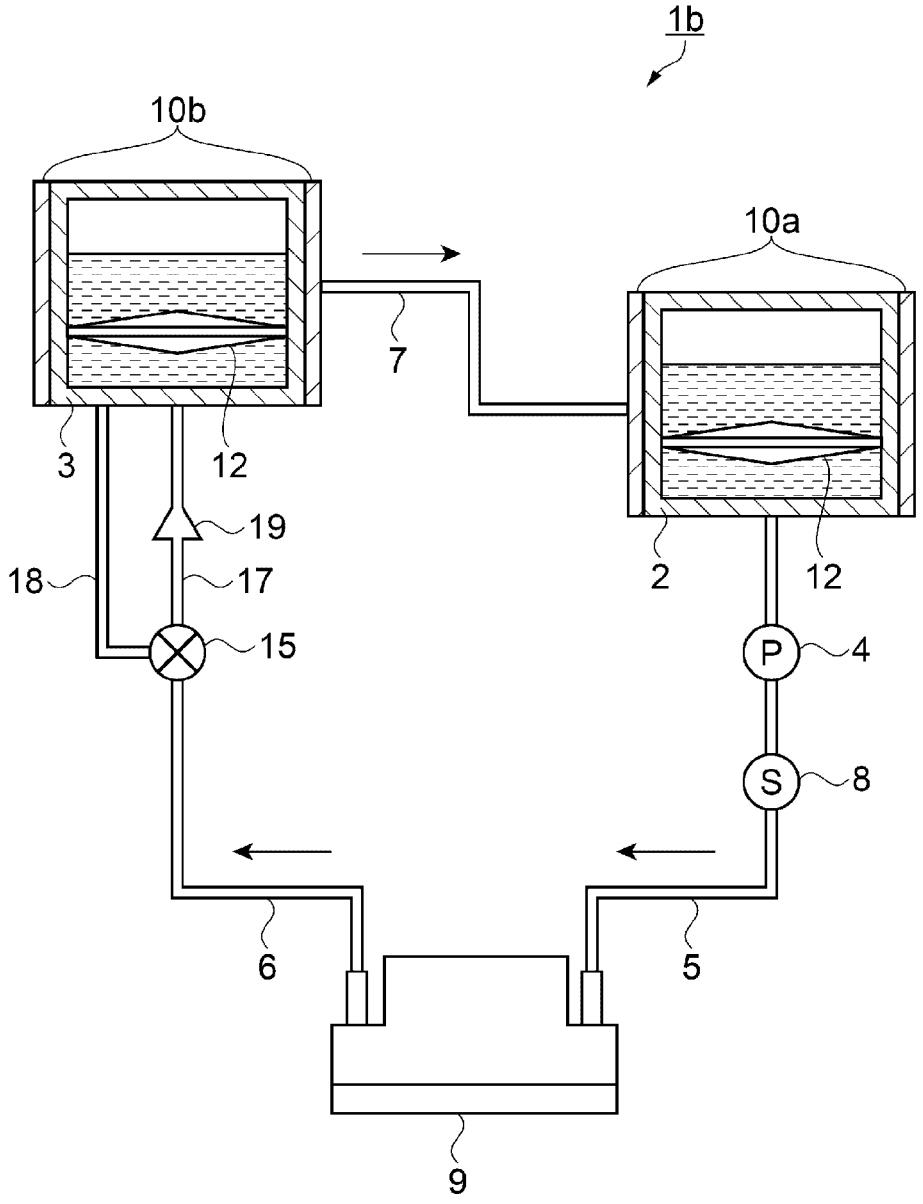
FIG. 5 is a schematic diagram illustrating the configuration of the liquid ejection device according to the second embodiment.

FIG. 5 is a schematic diagram illustrating a configuration of the liquid ejection device 1*b* in the second embodiment. The configuration of the liquid ejection device 1*b* will be described below with reference to FIG. 5.

The liquid ejection device 1*b* of the second embodiment has a similar configuration as that of the liquid ejection device 1*a* of the first embodiment and further includes a switching section 15 configured to switch between an unallowable state and an allowable state that correspond to the first state and the second state.

In this embodiment, a collection channel 17 and a collection channel 18 are connected to the collection channel 6 via the switching section 15. The switching section 15 can switch between a state in which the collection channel 6 and the collection channel 18 do not communicate with each other and the collection channel 6 and the collection channel 17 communicate with each other and a state in which the collection channel 6 and the collection channel 17 do not communicate with each other and the collection channel 6 and the collection channel 18 communicate with each other. The switching section 15 is configured such that flow channel switching is performed by a control section 16 serving as a switching control section. The control section 16 performs a flow channel switching operation in the switching section 15, based on information indicating the ejection amount per unit time, the number of times scanning is performed on the unit region, and the scanning speed at which scanning is performed on the unit region, or the like.

In this case, a one-way valve 19 used for preventing a backflow or the like is arranged in the collection channel 17. On the other hand, no one-way valve is arranged in the collection channel 18. Therefore, the state in which the collection channel 6 and the collection channel 18 do not communicate with each other and the collection channel 6 and the collection channel 17 communicate with each other corresponds to the unallowable state in which a flow of liquid from the collection tank 3 to the liquid ejection head 9 is not allowed. The state in which the collection channel 6 and the collection channel 17 do not communicate with each other and the collection channel 6 and the collection channel 18 communicate with each other corresponds to the allowable state in which a flow of the liquid from the collection tank 3 to the liquid ejection head 9 is allowed.

Figure 6:
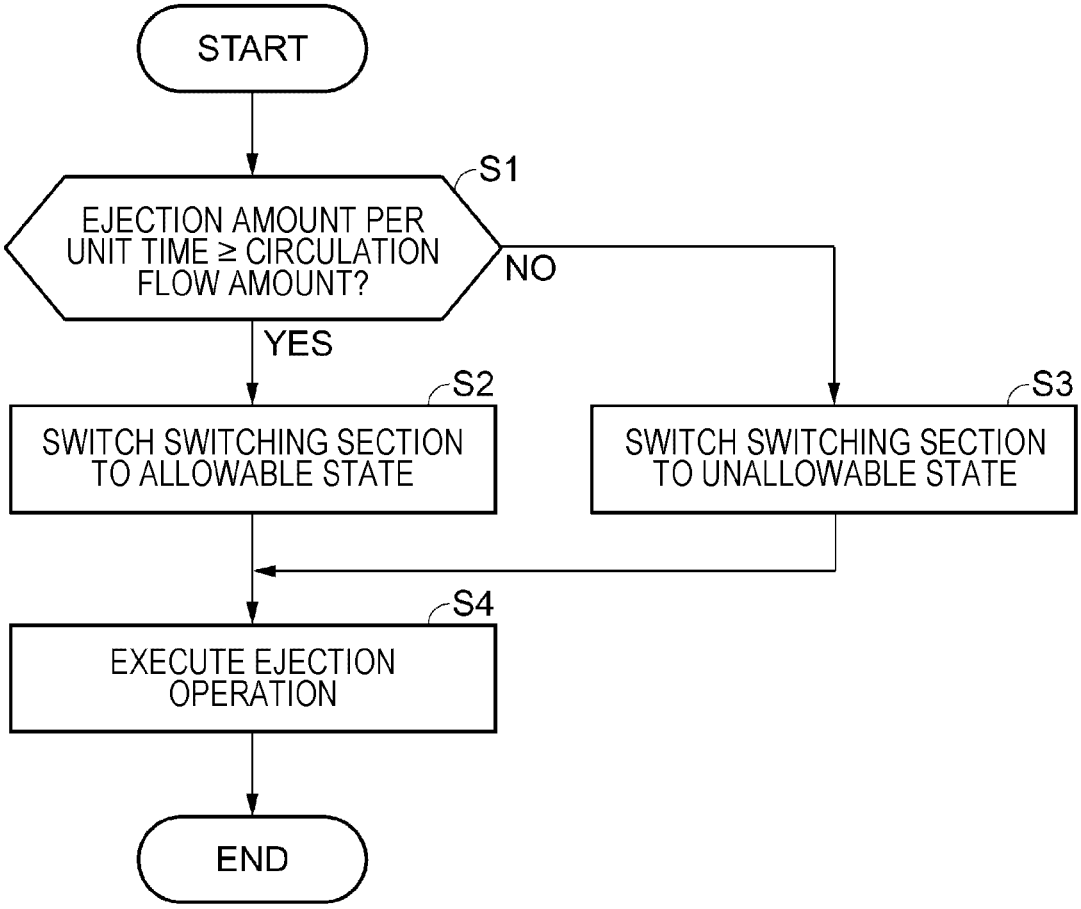
FIG. 6 is a flowchart illustrating a configuration of the liquid ejection device according to the second embodiment.

FIG. 6 is a flowchart illustrating a switching control method for controlling switching of the liquid ejection device 1*b*. The switching control method will be described below with reference to FIG. 6.

As illustrated in FIG. 6, in the control section 11, whether the allowable state or the unallowable state is established by the switching section 15 is determined. In Step S1, based on a printing condition sent to the liquid ejection head 9 by the control section 11, the ejection amount per unit time is calculated, when it is determined that a calculated value exceeds the circulation flow amount, the switching section 15 operates so as to be in the allowable state in Step S2 and, after a state in which the liquid in an amount corresponding to a shortage in the circulation flow amount can be supplied from the collection tank 3 is established, an ejection operation is executed in Step S4.

On the other hand, when it is determined that the calculated value is the circulation flow amount or less, the switching section 15 operates so as to be in the unallowable state in Step S3 and, after a state in which the ejection amount is supplemented by the circulation flow amount is established, the ejection operation is executed in Step S4.

When the ejection operation ends and a new printing condition is set, the printing condition sent from the control section 11 is detected again and, after the above described control operation is performed, the ejection operation is performed.

Figure 7:
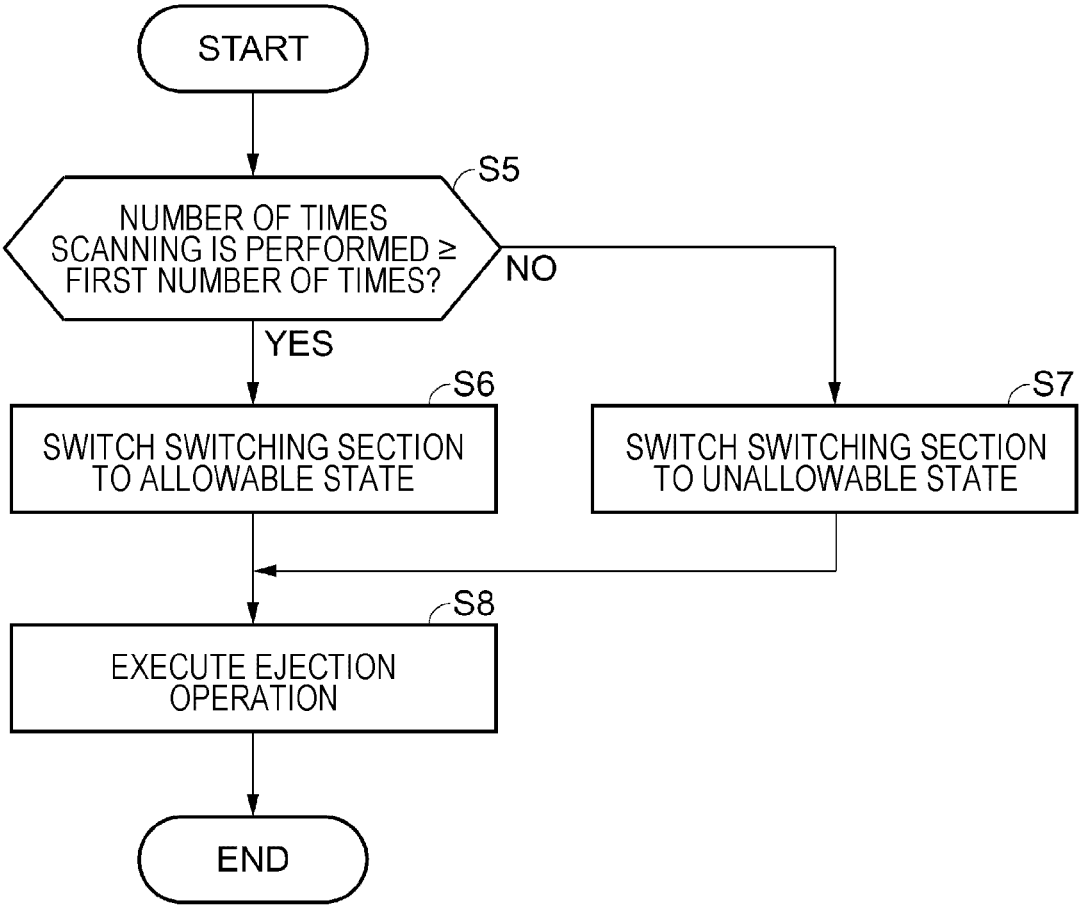
FIG. 7 is a flowchart illustrating a configuration of the liquid ejection device according to the second embodiment.

In the control method, for example, a rule in accordance with the number of times scanning is performed may be set. FIG. 7 is a flowchart illustrating a control method used in such a case. The number of times scanning is performed on the unit region is calculated based on the printing condition set by the control section 11 in Step S5, when it is determined that the number of times scanning is performed is smaller than a first number of times, the switching section 15 is put in the unallowable state in Step S7, and then, an ejection operation is executed in Step S8. On the other hand, when it is determined that the number of times scanning is performed is the first number of times or more, the switching section 15 is put in the allowable state in Step S6, and then, an ejection operation is performed in Step S8. Furthermore, this control can be performed to control the scanning speed in a similar manner.

As described above, according to the liquid ejection device 1*b* according to the second embodiment, the following advantageous effects can be achieved.

According to the second embodiment, in accordance with the ejection operation of the liquid ejection head 9 controlled by the control section 11, the control section 16 is controlled and the allowable state and the unallowable state can be switched from one to another by the switching section 15, so that a shortage of ink supply can be avoided and efficient circulation is enabled.

MODIFIED EXAMPLES

Figure 8:
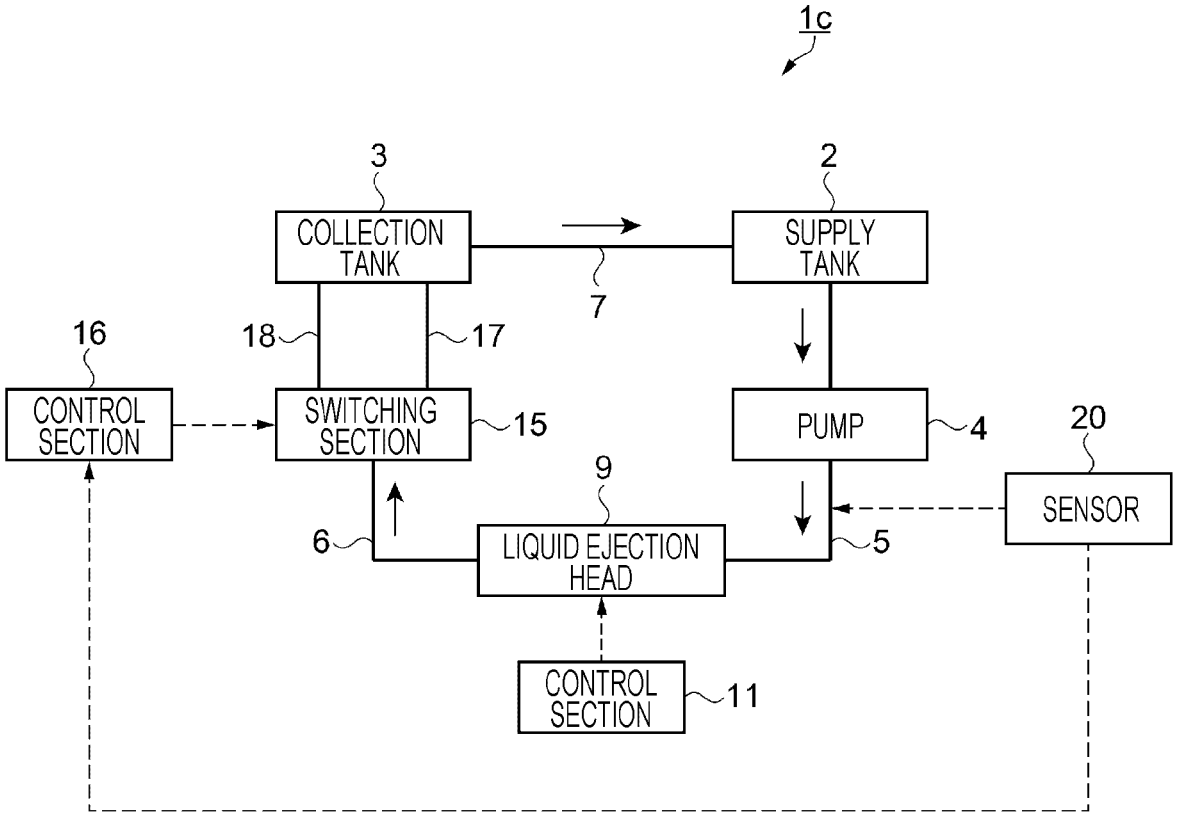
FIG. 8 is a block diagram illustrating a configuration of a liquid ejection device according to a modified example.
Figure 9:
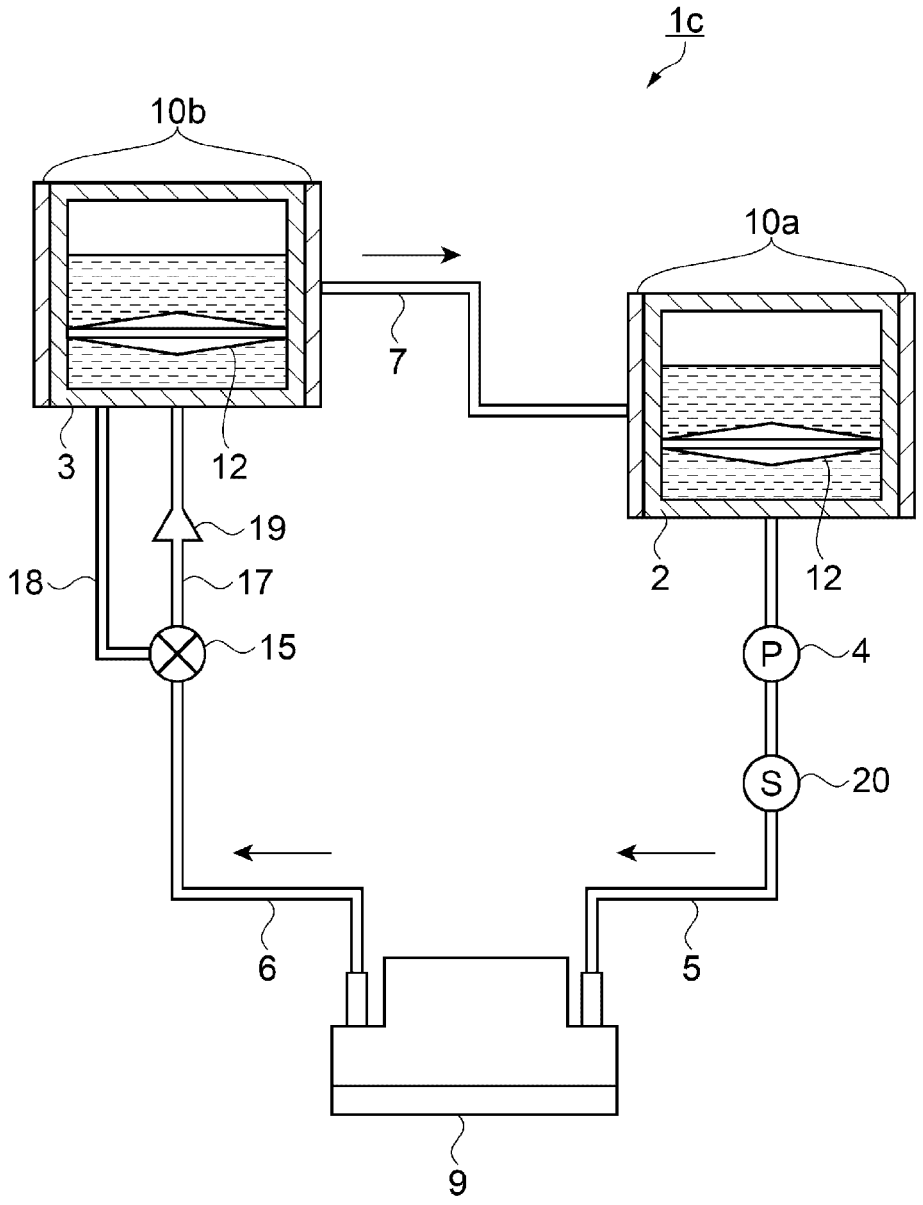
FIG. 9 is a schematic diagram illustrating the configuration of the liquid ejection device according to the modified example.

FIG. 8 is a block diagram illustrating an entire configuration of a liquid ejection device 1*c* in a modified example. FIG. 9 is a schematic diagram illustrating the configuration of the liquid ejection device 1*c* of the modified example. The entire configuration of the liquid ejection device 1*c* in the modified example will be described below with reference to FIG. 8 and FIG. 9. Note that the same components as those in the first embodiment and the second embodiment are denoted by the same reference symbols and overlapping description will be omitted.

As illustrated in FIG. 8, the liquid ejection device 1*c* includes the supply tank 2, the collection tank 3, the pump 4, the supply channel 5, the collection channel 6, a sensor 20, and the liquid ejection head 9, the switching section 15 is arranged in a flow channel from the liquid ejection head 9 to the collection tank 3, and the switching section 15 is controlled by the control section 16, so that flow channel switching is performed. Examples of a signal transmitted to the control section 16 include a signal detected by the sensor 20 serving as a flow amount detection section in the flow channel or the like. At this time, as the sensor 20, a flow amount sensor, a pressure sensor, or the like is used and, in a case in which the flow amount sensor is used, in accordance with a detected flow amount, the switching section 15 is controlled by the control section 16 and a flow channel switching operation is performed.

The liquid ejection device 1*c* of the modified example has a similar configuration to those of the liquid ejection devices 1*a* and 1*b* of the first embodiment and the second embodiment. The liquid ejection device 1*c* further includes the sensor 20 used for measuring the flow amount in the flow channel.

Figure 10:
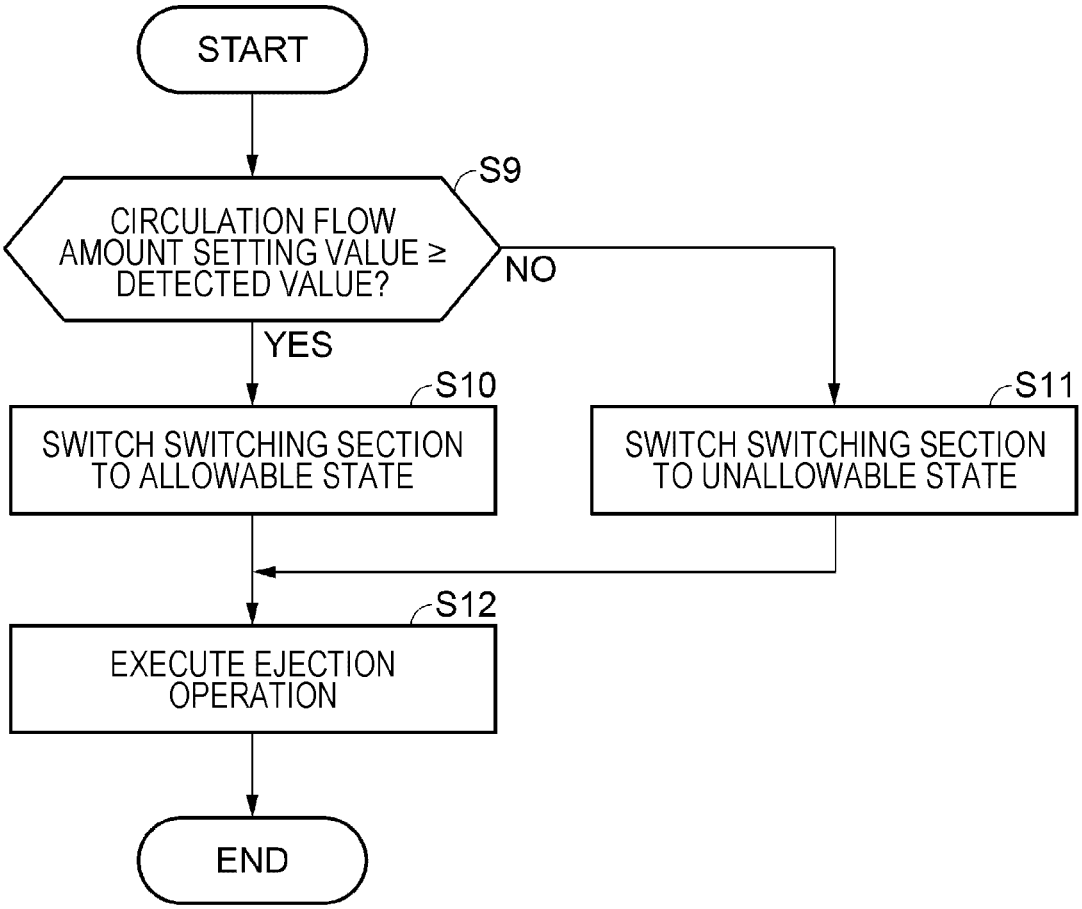
FIG. 10 is a flowchart illustrating the configuration of the liquid ejection device according to the modified example.

FIG. 10 is a flowchart illustrating a control method for the liquid ejection device 1*c* of the modified example. According to this control method, in the liquid ejection device 1*c*, in a circulation state including an ejection state, for example, when it is determined in Step S9 that the flow amount detected by the sensor 20 is less than the first flow amount, for example, due to clogging in the flow channel and increase of a liquid viscosity that are caused by bubbles or foreign matters, the switching section 15 is put in the allowable state in Step S10, and then, an ejection operation is executed in Step S12. On the other hand, when it is determined that the flow amount detected by the sensor 20 is the first flow amount or more, the switching section 15 is put in the unallowable state in Step S11, an ejection operation is executed in Step S12.

According to this modified example, regardless of the ejection operation of the liquid ejection head 9, in accordance with a result of detection performed by the sensor 20, the switching section 15 is controlled by the control section 16, the allowable state and the unallowable state can be switched from one to another and, even under some other ejection condition than a certain ejection condition, a shortage of ink supply can be avoided.

Contents derived from embodiments will be described below.

A liquid ejection device includes a liquid ejection head configured to eject liquid, a first reservoir configured to store liquid that is supplied to the liquid ejection head, a second reservoir configured to store liquid collected from the liquid ejection head, a first flow channel configured to communicate the liquid ejection head and the first reservoir with each other, a second flow channel configured to communicate the liquid ejection head and the second reservoir with each other, a third flow channel configured to communicate the first reservoir and the second reservoir with each other, and an ejection control section configured to control an ejection operation of ejecting the liquid from the liquid ejection head, the ejection control section controls the ejection operation to eject the liquid in each of a first state in which the liquid flows from the first reservoir to the liquid ejection head in the first flow channel, the liquid flows from the liquid ejection head to the second reservoir in the second flow channel, and the liquid flows from the second reservoir to the first reservoir in the third flow channel and a second state in which the liquid flows from the first reservoir to the liquid ejection head in the first flow channel and the liquid flows from the second reservoir to the liquid ejection head in the second flow channel.

According to this configuration, the second flow channel can be controlled between the first state and the second state and, in a case in which an ejection amount from the liquid ejection head is increased to a larger amount than a circulation flow amount, the second flow channel is controlled to be in the second state. Therefore, the supply amount of the liquid from the second reservoir can be supplemented, so that insufficient supply amount of the liquid can be avoided.

In the above described liquid ejection device, in the second state, the liquid may flow from the second reservoir to the first reservoir in the third flow channel.

According to this configuration, even in the second state, the liquid in the third flow channel flows from the second reservoir to the first reservoir, and therefore, a liquid storage amount of the first reservoir can be kept at a uniform level, so that the circulation flow amount in a supply channel can be stabilized.

In the above described liquid ejection device, a flow channel resistance of the second flow channel may be lower than a flow channel resistance of the first flow channel.

According to this configuration, when the second flow channel is put in the second state, the flow channel resistance of the second flow channel can be made small and sufficient liquid supply from the second flow channel can be performed.

The above described liquid ejection device may further include a temperature detection section configured to detect temperature of the liquid and a temperature adjustment section configured to adjust the temperature of the liquid, based on a detection result of the temperature detection section.

According to this configuration, temperature in the flow channels is adjusted based on the detection result of the temperature detection section, and thus, the liquid can be caused to have proper temperature, so that stable circulation can be performed. Moreover, a temperature difference between the first flow channel and the second flow channel in the second state can be eliminated and stable circulation can be performed.

In the above described liquid ejection device, the temperature detection section may include a first temperature detection section configured to detect the temperature of the liquid in the first flow channel and a second temperature detection section configured to detect the temperature of the liquid in the second flow channel, the temperature adjustment section may include a first temperature adjustment section arranged in the first reservoir and a second temperature adjustment section arranged in the second reservoir, the first temperature adjustment section may be configured to adjust the temperature of the liquid in the first reservoir, based on a detection result of the first temperature detection section, and the second temperature adjustment section may be configured to adjust the temperature of the liquid in the second reservoir, based on a detection result of the second temperature detection section.

According to this configuration, the temperature of the liquid in the first reservoir and the temperature of the liquid in the second reservoir can be properly kept.

In the above described liquid ejection device, the first temperature adjustment section and the second temperature adjustment section may be configured to adjust the temperature of the liquid such that the temperature of the liquid in the second reservoir is higher than the temperature of the liquid in the first reservoir.

According to this configuration, a temperature gradient can be formed between the first reservoir and the second reservoir, a flow of the liquid due to the temperature gradient can be caused to occur, and circulation in a feedback channel can be stabilized.

In the above described liquid ejection device, a filter configured to catch a foreign matter in the liquid may be provided in the first reservoir and the second reservoir.

According to this configuration, the liquid that is supplied from the first reservoir and the second reservoir is filtered by the filter, so that bubbles or foreign matters can be prevented from being mixed in. Moreover, the filter is arranged in the first reservoir and the second reservoir, and thus, a filter area can be increased, so that a concern about reduction of the flow amount due to the flow channel resistance can be eliminated.

In the above described liquid ejection device, the second reservoir may be arranged higher in a gravity direction than the first reservoir.

According to this configuration, water head difference control of the feedback channel that extends from the first reservoir and connects to the second reservoir can be performed and the liquid can be caused to circulate by a water head pressure.

In the above described liquid ejection device, the first reservoir and the second reservoir may be arranged higher in the gravity direction than the liquid ejection head.

According to this configuration, the first reservoir and the second reservoir can be arranged near the liquid ejection head, so that space-saving of a circulation system can be achieved and reduction of a temperature adjustment function due to heat radiation between the flow channels can be suppressed.

In the above described liquid ejection device, the ejection control section may be configured to control the ejection operation such that, when an ejection amount per unit time is a first amount, the liquid is ejected in the first state and, when the ejection amount per unit time is a second amount that is larger than the first amount, the liquid is ejected in the second state.

When the ejection amount exceeds the first amount, it is likely that the supply amount of the liquid is insufficient in the first state. However, according to the above described configuration, the first state can be switched to the second state, so that a shortage of liquid supply can be avoided.

In the above described liquid ejection device, the liquid ejection head may be configured to perform the ejection operation while performing scanning relatively on a unit region on a recording medium, the ejection control section may be configured to control the ejection operation such that, when the number of times the scanning is performed on the unit region is a first number of times, the liquid is ejected in the first state and, when the number of times the scanning is performed on the unit region is a second number of times that is less than the first number of times, the liquid is ejected in the second state.

In a case in which printing is performed, it is likely that, when the number of times the scanning is performed on the unit region is less than the first number of times, the ejection amount during one scanning is increased and the supply amount of the liquid is insufficient. However, according to the above described configuration, the first state can be switched to the second state, so that a shortage of liquid supply can be avoided.

In the above described liquid ejection device, the liquid ejection head may be configured to perform the ejection operation while performing scanning relatively on a unit region on a recording medium, the ejection control section may be configured to control the ejection operation such that, when speed of the scanning performed on the unit region is first speed, the liquid is ejected in the first state and, when the speed of the scanning performed on the unit region is second speed that is higher than the first speed, the liquid is ejected in the second state.

In a case in which printing is performed, it is likely that, when the speed of the scanning performed on the unit region is the second speed that is higher than the first speed, the ejection amount per unit time is increased and the supply amount of the liquid is insufficient. However, according to the above described configuration, the first state can be switched to the second state, so that a shortage of liquid supply can be avoided.

In the above described liquid ejection device, the liquid ejection head may include a liquid ejection section configured to eject liquid, a fourth flow channel configured to communicate the liquid ejection section and the first flow channel with each other, and a fifth flow channel configured to communicate the liquid ejection section and the second flow channel with each other, and a flow channel resistance of the fifth flow channel may be smaller than a flow channel resistance of the fourth flow channel.

From a view point of the bubble discharging capability of the liquid ejection section, in the fourth flow channel, a liquid flow velocity needs to be increased, and the flow channel resistance has to be reduced, and therefore, in a case in which there is only the first state, it is likely that the liquid flow amount is insufficient accordingly. However, according to the above described configuration, in the fifth flow channel, the flow channel resistance can be made small, so that a shortage of liquid supply can be avoided in the second state.

In the above described liquid ejection device, the second flow channel may further include a switching section configured to switch between an allowable state in which a flow of the liquid from the second reservoir to the liquid ejection head is allowed and an unallowable state in which a flow of the liquid from the second reservoir to the liquid ejection head is not allowed, and a switching control section configured to control an operation of the switching section such that a flow of the liquid is put in the second state by putting the switching section in the allowable state and a flow of the liquid is put in the first state by putting the switching section in the unallowable state.

According to this configuration, the switching section is controlled in accordance with the ejection operation of the liquid ejection head to perform switching between the allowable state and the unallowable state, so that an unnecessary flow from the second reservoir can be suppressed, more efficient circulation can be performed, and a shortage of liquid supply can be avoided.

In the above described liquid ejection device, the switching control section may be configured to control, when a signal from a flow amount detection section arranged in the first flow channel is detected and a flow amount that can be possibly in the allowable state is detected, switching to the allowable state, regardless of the ejection operation.

According to this configuration, regardless of the ejection operation, a shortage of the flow amount in a case in which the viscosity of the liquid is increased by clogging, loss of the temperature adjustment function, sedimentation of components, or the like due to bubbles or foreign matters in the liquid flow channels can be detected and a shortage of liquid supply can be suppressed by switching between the allowable state and the unallowable state according to a result of the detection.

What is claimed is:

1. A liquid ejection device comprising:

a liquid ejection head configured to eject liquid;

a first reservoir configured to store liquid that is supplied to the liquid ejection head;

a second reservoir configured to store liquid collected from the liquid ejection head;

a first flow channel configured to communicate the liquid ejection head and the first reservoir with each other;

a second flow channel configured to communicate the liquid ejection head and the second reservoir with each other;

a third flow channel configured to communicate the first reservoir and the second reservoir with each other; and an ejection control section configured to control an ejection operation of ejecting the liquid from the liquid ejection head, wherein the ejection control section controls the ejection operation to eject the liquid in each of a first state in which the liquid flows from the first reservoir to the liquid ejection head in the first flow channel, the liquid flows from the liquid ejection head to the second reservoir in the second flow channel, and the liquid flows from the second reservoir to the first reservoir in the third flow channel, and a second state in which the liquid flows from the first reservoir to the liquid ejection head in the first flow channel and the liquid flows from the second reservoir to the liquid ejection head in the second flow channel.

2. The liquid ejection device according to claim 1, wherein in the second state, the liquid flows from the second reservoir to the first reservoir in the third flow channel.

3. The liquid ejection device according to claim 1, wherein a flow channel resistance of the second flow channel is smaller than a flow channel resistance of the first flow channel.

4. The liquid ejection device according to claim 1, further comprising:

a temperature detection section configured to detect temperature of the liquid; and a temperature adjustment section configured to adjust the temperature of the liquid, based on a detection result of the temperature detection section.

5. The liquid ejection device according to claim 4, wherein the temperature detection section includes a first temperature detection section configured to detect the temperature of the liquid in the first flow channel and a second temperature detection section configured to detect the temperature of the liquid in the second flow channel, the temperature adjustment section includes a first temperature adjustment section arranged in the first reservoir and a second temperature adjustment section arranged in the second reservoir, the first temperature adjustment section adjusts the temperature of the liquid in the first reservoir, based on a detection result of the first temperature detection section, and the second temperature adjustment section adjusts the temperature of the liquid in the second reservoir, based on a detection result of the second temperature detection section.

6. The liquid ejection device according to claim 5, wherein the first temperature adjustment section and the second temperature adjustment section adjust the temperature of the liquid such that the temperature of the liquid in the second reservoir is higher than the temperature of the liquid in the first reservoir.

7. The liquid ejection device according to claim 1, wherein a filter configured to catch a foreign matter in the liquid is provided in the first reservoir and the second reservoir.

8. The liquid ejection device according to claim 1, wherein the second reservoir is arranged higher in a gravity direction than the first reservoir.

9. The liquid ejection device according to claim 1, wherein the first reservoir and the second reservoir are arranged higher in a gravity direction than the liquid ejection head.

10. The liquid ejection device according to claim 1, wherein the ejection control section controls the ejection operation such that, when an ejection amount per unit time is a first amount, the liquid is ejected in the first state and, when the ejection amount per unit time is a second amount that is larger than the first amount, the liquid is ejected in the second state.

11. The liquid ejection device according to claim 1, wherein the liquid ejection head performs the ejection operation while performing scanning relatively on a unit region on a recording medium, and the ejection control section controls the ejection operation such that, when the number of times the scanning is performed on the unit region is a first number of times, the liquid is ejected in the first state and, when the number of times the scanning is performed on the unit region is a second number of times that is less than the first number of times, the liquid is ejected in the second state.

12. The liquid ejection device according to claim 1, wherein the liquid ejection head performs the ejection operation while performing scanning relatively on a unit region on a recording medium, and the ejection control section controls the ejection operation such that, when speed of the scanning performed on the unit region is first speed, the liquid is ejected in the first state and, when the speed of the scanning performed on the unit region is second speed that is higher than the first speed, the liquid is ejected in the second state.

13. The liquid ejection device according to claim 1, wherein the liquid ejection head includes a liquid ejection section configured to eject liquid, a fourth flow channel configured to communicate the liquid ejection section and the first flow channel with each other, and a fifth flow channel configured to communicate the liquid ejection section and the second flow channel with each other, and a flow channel resistance of the fifth flow channel is smaller than a flow channel resistance of the fourth flow channel.

14. The liquid ejection device according to claim 1, wherein the second flow channel further includes a switching section configured to switch between an allowable state in which a flow of the liquid from the second reservoir to the liquid ejection head is allowed and an unallowable state in which a flow of the liquid from the second reservoir to the liquid ejection head is not allowed, and a switching control section configured to control an operation of the switching section such that a flow of the liquid is put in the second state by putting the switching section in the allowable state and a flow of the liquid is put in the first state by putting the switching section in the unallowable state.

15. The liquid ejection device according to claim 14, wherein when a signal from a flow amount detection section arranged in the first flow channel is detected and a flow amount that can be possibly in the allowable state is detected, the switching control section controls switching to the allowable state regardless of the ejection operation.

16. A liquid ejection device comprising:

a liquid ejection head configured to eject liquid;

a first reservoir configured to store liquid that is supplied to the liquid ejection head;

a second reservoir configured to store liquid collected from the liquid ejection head;

a first flow channel configured to communicate the liquid ejection head and the first reservoir with each other;

a second flow channel configured to communicate the liquid ejection head and the second reservoir with each other;

a third flow channel configured to communicate the first reservoir and the second reservoir with each other; and an ejection control section configured to control an ejection operation of ejecting the liquid from the liquid ejection head, wherein the ejection control section controls the ejection operation to eject the liquid in each of a first state in which the liquid flows from the first reservoir to the liquid ejection head in the first flow channel, the liquid flows from the liquid ejection head to the second reservoir in the second flow channel, and the liquid flows from the second reservoir to the first reservoir in the third flow channel, and a second state in which the liquid flows from the first reservoir to the liquid ejection head in the first flow channel and the liquid flows from the second reservoir to the liquid ejection head in the second flow channel, wherein the ejection control section controls the ejection operation such that, when an ejection amount per unit time is a first amount, the liquid is ejected in the first state and, when the ejection amount per unit time is a second amount that is larger than the first amount, the liquid is ejected in the second state.

17. A liquid ejection device comprising:

a liquid ejection head configured to eject liquid;

a first reservoir configured to store liquid that is supplied to the liquid ejection head;

a second reservoir configured to store liquid collected from the liquid ejection head;

a first flow channel configured to communicate the liquid ejection head and the first reservoir with each other;

a second flow channel configured to communicate the liquid ejection head and the second reservoir with each other;

a third flow channel configured to communicate the first reservoir and the second reservoir with each other; and an ejection control section configured to control an ejection operation of ejecting the liquid from the liquid ejection head, wherein the ejection control section controls the ejection operation to eject the liquid in each of a first state in which the liquid flows from the first reservoir to the liquid ejection head in the first flow channel, the liquid flows from the liquid ejection head to the second reservoir in the second flow channel, and the liquid flows from the second reservoir to the first reservoir in the third flow channel, and a second state in which the liquid flows from the first reservoir to the liquid ejection head in the first flow channel and the liquid flows from the second reservoir to the liquid ejection head in the second flow channel, wherein the liquid ejection head performs the ejection operation while performing scanning relatively on a unit region on a recording medium, and the ejection control section controls the ejection operation such that, when the number of times the scanning is performed on the unit region is a first number of times, the liquid is ejected in the first state and, when the number of times the scanning is performed on the unit region is a second number of times that is less than the first number of times, the liquid is ejected in the second state.

* * * * *